US009287649B2

(12) United States Patent
Okayasu et al.

(10) Patent No.: US 9,287,649 B2
(45) Date of Patent: Mar. 15, 2016

(54) CONNECTOR AND HOUSING

(71) Applicant: Sumitomo Wiring Systems, Ltd., Yokkaichi (JP)

(72) Inventors: Yasushi Okayasu, Yokkaichi (JP); Yukari Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/305,385

(22) Filed: Jun. 16, 2014

(65) Prior Publication Data

US 2014/0370737 A1 Dec. 18, 2014

(30) Foreign Application Priority Data

Jun. 17, 2013 (JP) ..... 2013-126469
Nov. 28, 2013 (JP) ..... 2013-245910

(51) Int. Cl.
*H01R 13/40* (2006.01)
*H01R 13/422* (2006.01)
*H01R 13/424* (2006.01)
*H01R 11/26* (2006.01)

(52) U.S. Cl.
CPC ..... *H01R 13/4223* (2013.01); *H01R 13/424* (2013.01); *H01R 11/26* (2013.01)

(58) Field of Classification Search
CPC .. H01R 11/26; H01R 13/4223; H01R 13/424; H01R 13/4226
USPC ..... 439/595, 733.1, 810
See application file for complete search history.

(56) References Cited

U.S. PATENT DOCUMENTS 7,572,150 B2 * 8/2009 Matsuoka ..... H01R 13/207 439/626
8,342,880 B2 * 1/2013 Kato ..... H01R 9/032 439/382
8,747,157 B2 * 6/2014 Tashiro ..... H01R 13/4364 439/246
8,790,135 B2 * 7/2014 Maegawa ..... H01R 43/24 439/246

FOREIGN PATENT DOCUMENTS

JP 2008-300329 12/2008

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A connector (10) includes terminals (40) each of which has a plate-like connecting portion (42) formed with a nut mounting hole (43). A housing (20) is formed with terminal accommodating portions (21) capable of accommodating the terminals (40). Nuts (44) with bolt holes (45) are mounted integrally on the connecting portion (42) so that each bolt hole (45) coaxially communicates with the nut mounting hole (43). Locking lances (29) are formed in the housing (20) and retain the connecting portions (42) by locking outer parts of the nuts (44) from behind. Front stops (23) are formed in the terminal accommodating portion (21) and stop the connecting portion (42) at a front end position by locking projections (47) formed on the terminal (40) to project from the terminal (40) from front.

5 Claims, 26 Drawing Sheets

CONNECTOR AND HOUSING

BACKGROUND

1. Field of the Invention

The invention relates to a connector and a housing provided with a nut.

2. Description of the Related Art

Japanese Unexamined Patent Publication No. 2008-300329 discloses a connector with a terminal that has a plate-like connecting portion formed with a bolt hole and a housing with a cavity capable of accommodating the terminal. The connecting portion of the terminal has a locking hole to be locked by a locking lance in the cavity. The bolt hole is arranged before the locking hole. On the other hand, a mating connector connectable includes a terminal block to which the connecting portion of the terminal is to be connected. The terminal block has a busbar formed with a bolt hole and a nut arranged below the busbar. The connecting portion of the terminal is arranged on the busbar of the terminal block if the connector and the mating connector are connected. The terminal and the busbar then are connected electrically conductively by inserting a bolt into the respective bolt holes and tightening the bolt into the nut.

The bolt hole and the locking hole need to be juxtaposed in a front-back direction in the connecting portion in the above-described connector. Thus, the connecting portion is long in the front-back direction. The cavity for accommodating the terminal also is long in the front-back direction as a matter of course. Accordingly, the housing is long in the front-back direction and the connector is long in the front-back direction.

The invention was completed based on the above situation and aims to make a connector smaller in a front-back direction.

SUMMARY OF THE INVENTION

The invention is directed to a connector with a terminal that has a plate-like connecting portion formed with a nut mounting hole. The connector also has a housing formed with a terminal accommodating portion capable of accommodating the terminal and a nut including a bolt hole. The nut is mounted integrally on the connecting portion so that the bolt hole communicates coaxially with the nut mounting hole. A locking portion is formed in the housing and is configured to retain the connecting portion by locking an outer edge part of the nut from behind. A front stop is formed in the terminal accommodating portion and is configured to stop the connecting portion at a front end position by locking a projection formed on the terminal to project from the terminal from front.

A locking hole to be locked by the locking portion need not be formed separately from the bolt hole. Thus, the connecting portion can be shortened in a front-back direction since the locking portion locks the outer edge of the nut from behind. As a result, the terminal accommodating portion for accommodating the terminal can be shortened in the front-back direction and the connector can be made smaller in the front-back direction.

The locking portion may be a locking lance cantilevered forward, and the front end of the locking lance may be located before a front end opening of the terminal accommodating portion. Thus, the locking lance easily locks the outer edge of the nut even if the nut is on a front part of the connecting portion.

The projection may project laterally from a side edge of the connecting portion, and the front stop may be formed on an inner side wall of a front opening of the terminal accommodating portion. More particularly, the front stop preferably is at apposition on the front end opening of the terminal accommodating portion where a wall is formed over the entire periphery. Thus, the inner side wall of the front end opening of the terminal accommodating portion will not undergo a widening deformation even if the projection applies a strong force to the front stop from and accordingly the connecting portion is stopped firmly at the front end position.

The housing may include a fitting that can fit into a mounting hole that penetrates through a metal casing. A metal shield shell surrounds a part of the housing that is outside the metal casing and is attached a shield shell attaching portion of the metal casing. Accordingly, the casing and the shield shell protect the housing during a collision and avoid a situation where the housing is broken and terminals are shorted to each other.

The invention enables a connector to be smaller in a front-back direction.

DETAILED DESCRIPTION OF THE PREFERRED EMBODIMENTS

Figure 1:
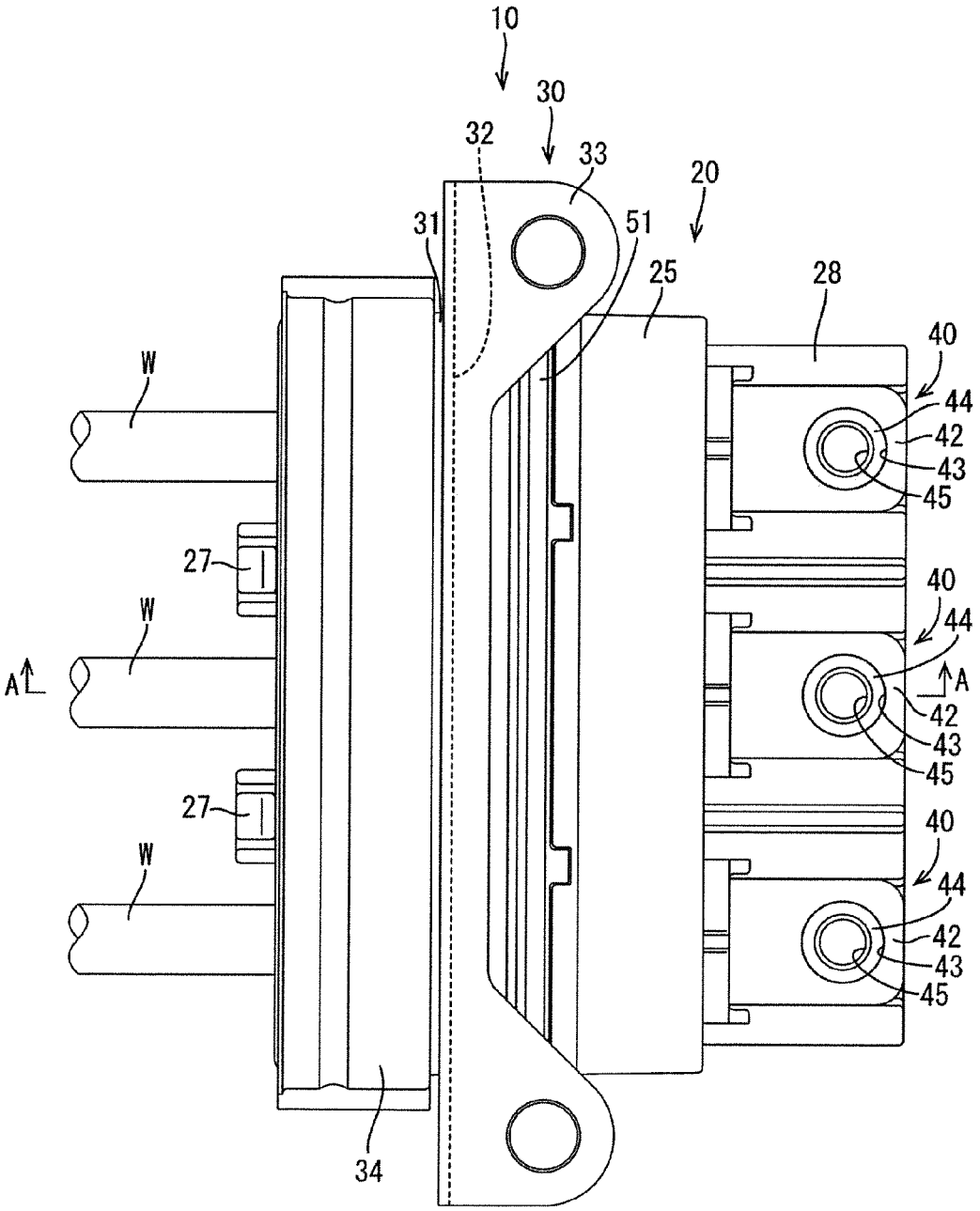
FIG. 1 is a plan view of a connector in a first embodiment.

A first embodiment of the invention is described with reference to FIGS. 1 to 8. A connector 10 in this embodiment includes a plurality of wires W, a housing 20 made of synthetic resin, a shield shell 30 made of metal and a plurality of terminals 40, as shown in FIG. 1. The connector 10 is fittable into a mounting hole of an unillustrated device, such as a mounting hole that penetrates through a metal casing (such as, the mounting hole 2 in the case 1 of FIG. 17). In the following description, fitting and separating directions of the connector 10 into the mounting hole are referred to as forward and backward directions, and a side to be fit into the mounting hole (right side in FIG. 1) is referred to as the front.

The wire W has a core W1 formed by bundling a plurality of metal strands and an insulation coating W2 covers the core W1. The core W1 is made of copper or copper alloy and the insulation coating W2 is made of resin. The insulation coating W2 is removed at an end of the wire W to expose the core W1, and the terminal 40 is connected to this exposed core W1.

Figure 4:
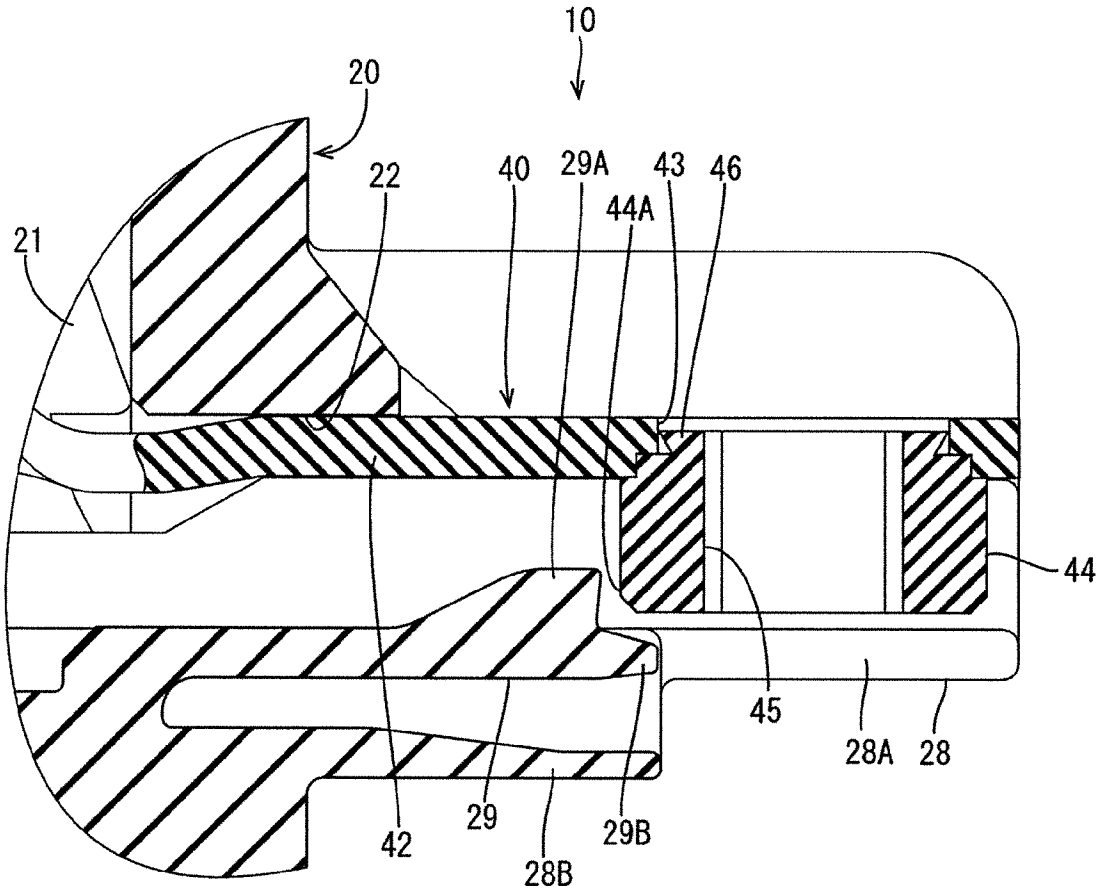
FIG. 4 is a partial enlarged section of FIG. 3.
Figure 5:
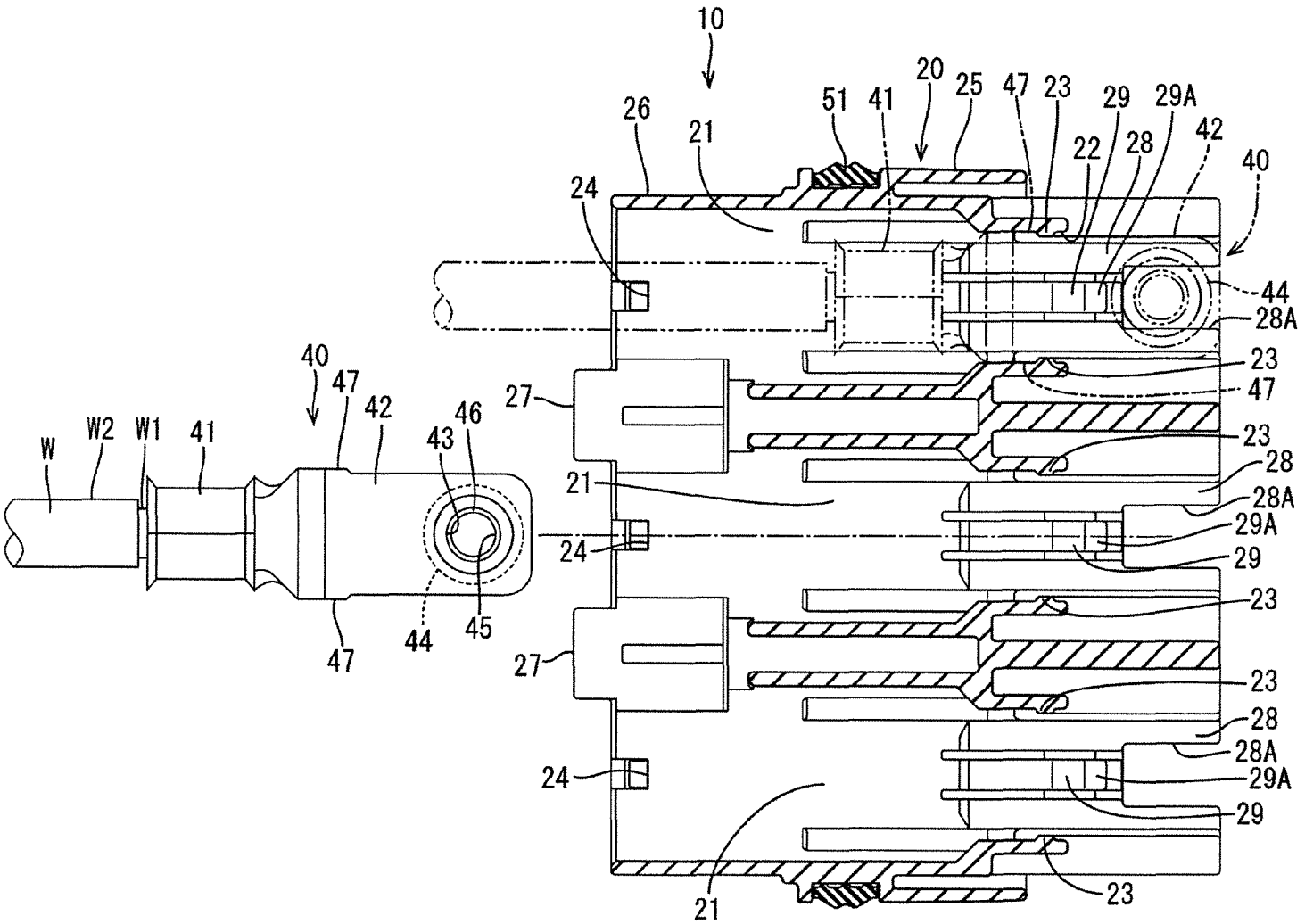
FIG. 5 is a plan view in section showing a state where terminals are inserted into terminal accommodating portions and stopped at front end positions.
Figure 6:
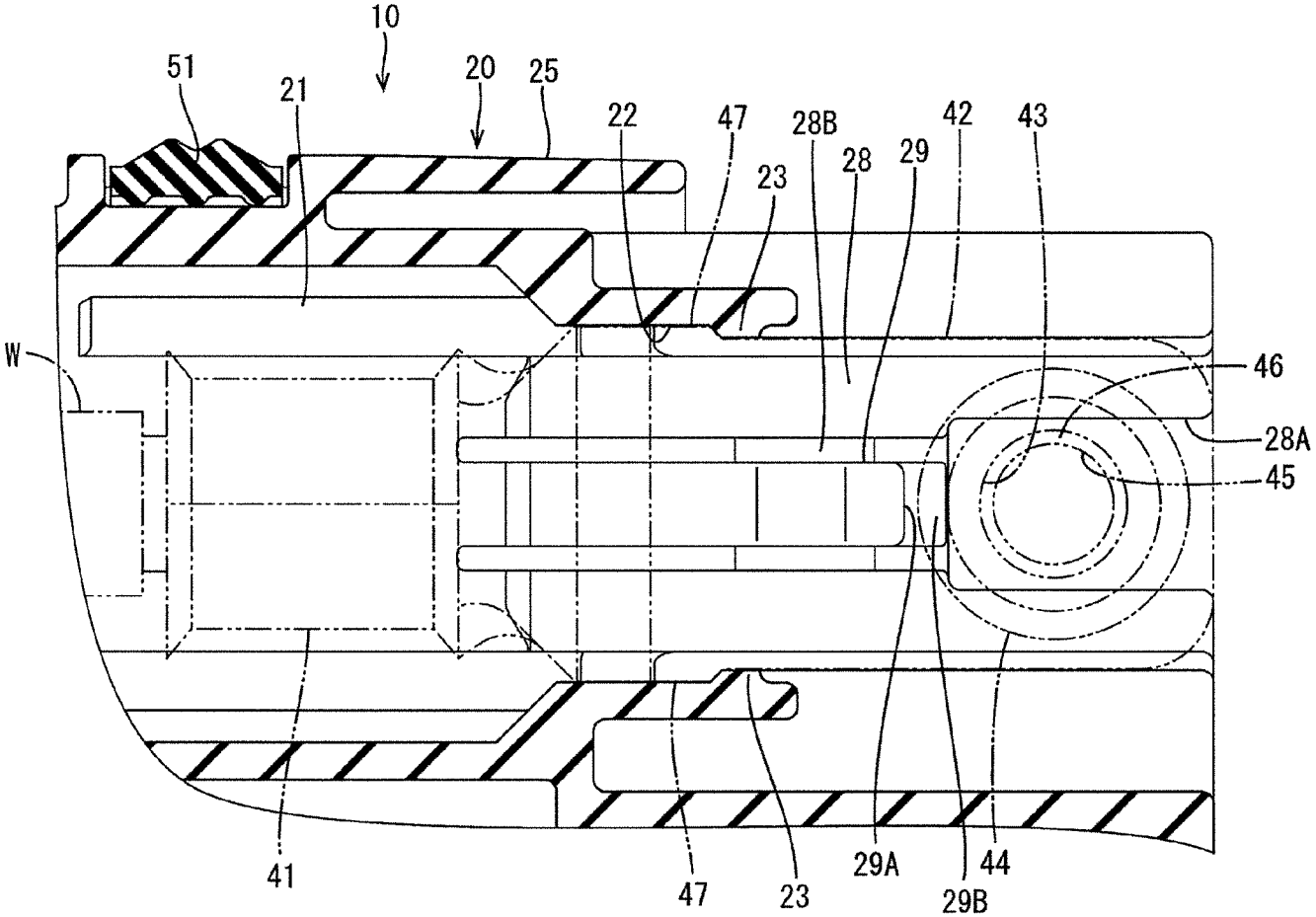
FIG. 6 is a partial enlarged section of FIG. 5.

As shown in FIG. 5, the terminal 40 includes a barrel 41 to be crimped to the core W1 of the wire W and a connecting portion 42 formed before this barrel 41. A nut mounting hole 43 penetrates through the connecting portion 42. A nut 44 is mounted integrally in an edge of the nut mounting hole 43. As shown in FIG. 4, the nut 44 has a bolt hole 45 that is coaxial with the nut mounting hole 43 and a step 46 of the nut 44 is press-fit into the nut mounting hole 43 so that the bolt hole 45 and the nut mounting hole 43 communicate.

As shown in FIG. 5, the housing 20 includes terminal accommodating portions 21 capable of receiving the terminals 40. The terminals 40 are insertable into the terminal accommodating portions 21 from behind and a plurality of terminal accommodating portions 21 are arranged side by side in a direction perpendicular to an inserting direction of the terminals 40. The terminal accommodating portion 21 has a front end opening 22, and the terminal 40 is accommodated in the terminal accommodating portion 21 so that a front part of the connecting portion 42 projects forward from the front end opening 22.

Figure 2:
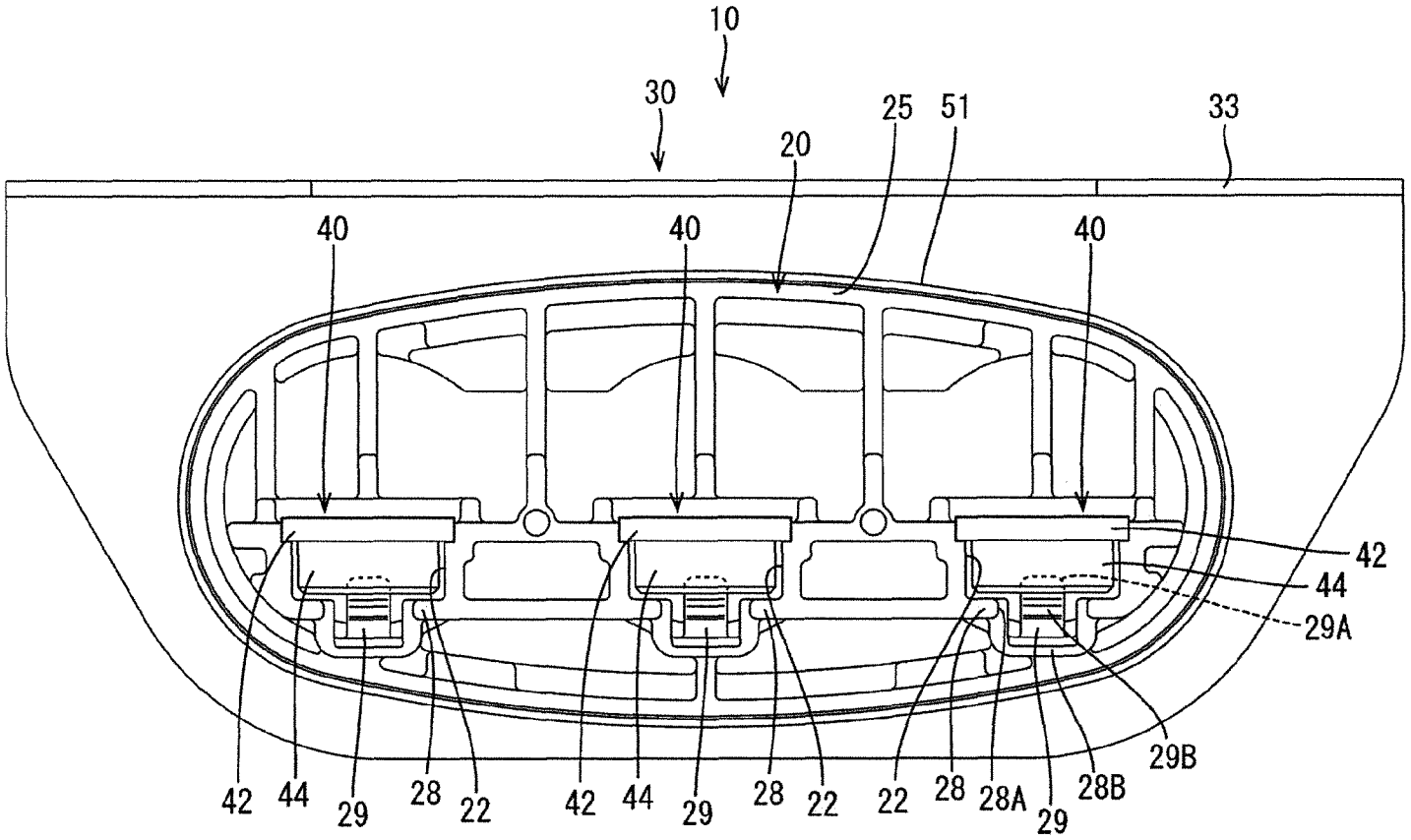
FIG. 2 is a front view of the connector.

Two front stops 23 project from inner side walls of the front end opening 22 of the terminal accommodating portion 21. On the other hand, two projections 47 project laterally on opposite side edges of the connecting portion 42. When the connecting portion 42 is inserted into the front end opening 22 of the terminal accommodating portion 21, the respective projections 47 contact the front stops 23 from behind so that the connecting portion 42 is stopped at a front end position. The front end opening 22 of the terminal accommodating portion 21 is formed with a wall over the entire periphery, as shown in FIG. 2. Thus, opening deformations of the inner side walls of the front end opening 22 are suppressed and the connecting portion 42 is stopped reliably at the front end position when the respective projections 47 contact with the respective front stops 23.

Figure 3:
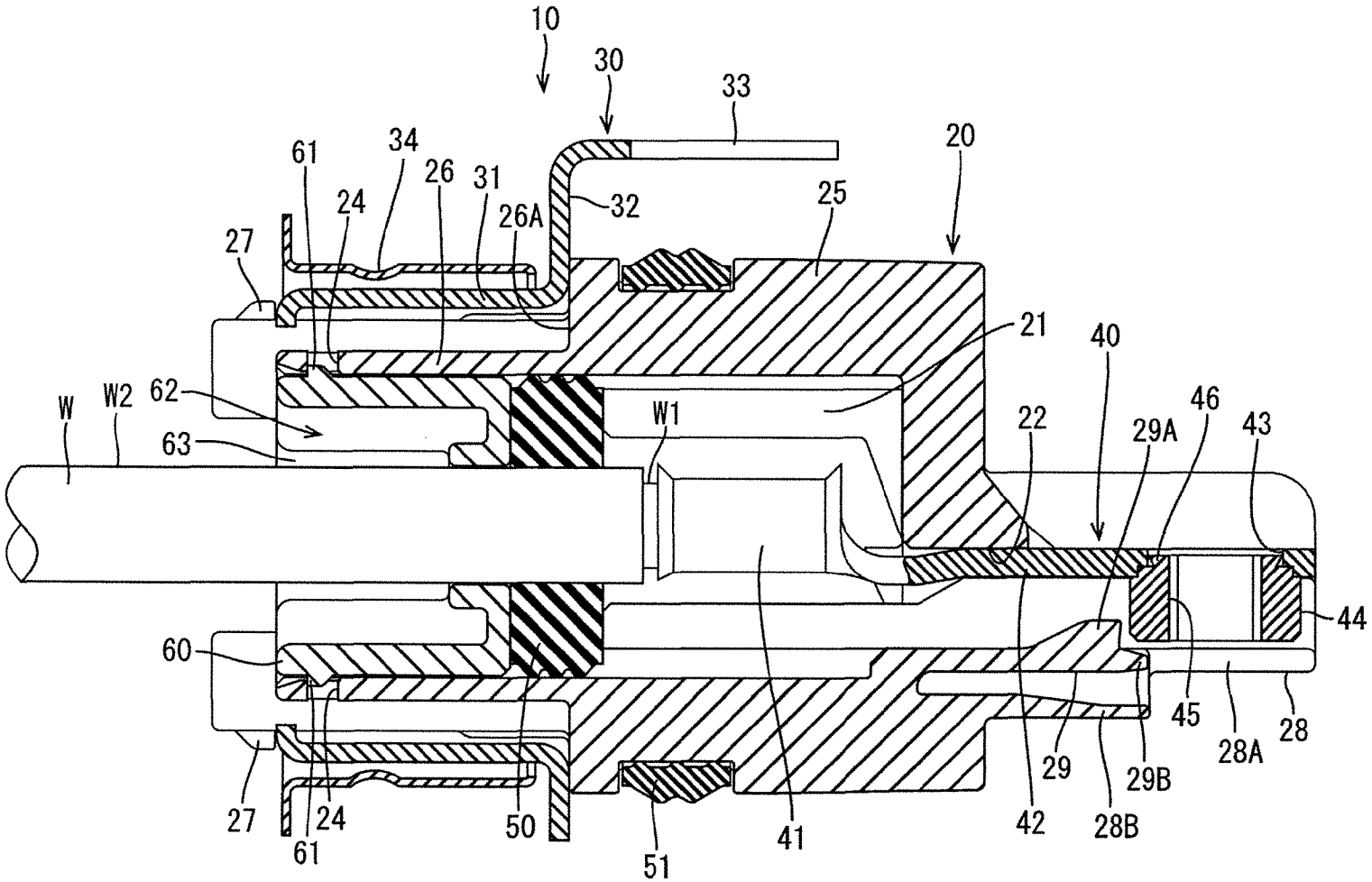
FIG. 3 is a section along A-A of FIG. 1.

As shown in FIG. 3, a rear end part (part corresponding to the projecting portions 47) of the connecting portion 42, the barrel 41 and an end part of the wire W are accommodated in the terminal accommodating portion 21 of the housing 20. A rubber plug 50 in the form of a circular ring is mounted on the end part of the wire W and a back retainer 60 is mounted behind this rubber plug 50. The rubber plug 50 is sandwiched between the outer peripheral surface of the insulation coating W2 of the wire W and the inner peripheral surface of the terminal accommodating portion 21. This causes the interior of the terminal accommodating portion 21 to be held in a sealed state.

The back retainer 60 includes lock protrusions 61 engageable with lock holes 24 formed in rear end parts of the terminal accommodating portion 21 to prevent a backward detachment of the back retainer 60 and the rubber plugs 50 from the terminal accommodating portion 21. As shown in FIG. 3, the back retainer 60 is formed with wire insertion holes 62 that allow individual insertion of the wires W, and a partition wall 63 is formed between each pair of adjacent wire insertion holes 62.

A seal ring 51 is mounted on the outer peripheral surface of a fitting 25 of the housing 20 to be fit into the mounting hole of the device. This seal ring 51 is sandwiched between the outer peripheral surface of the fitting 25 and the inner peripheral surface of the mounting hole, thereby sealing between the connector 10 and the casing of the device.

A shield shell attaching portion 26 is formed on a side of the outer peripheral surface of the housing 20 behind the fitting 25. The shield shell attaching portion 26 has a height lower than the fitting 25 and a step 26A is formed between the fitting 25 and the shield shell attaching portion 26.

The shield shell 30 includes a caulking tube 31 to be fit externally on the outer peripheral surface of the shield shell attaching portion 26 and a step locking surface 32 spreading radially outward from the front edge of this caulking tube portion 31. Further, as shown in FIG. 1, a mounting portion 33 to be bolt-fastened to the casing of the device is formed to protrude forward on the upper edge of the step locking surface 32.

The caulking tube 31 has a wide elliptical shape and is attached to the shield shell attaching portion 26 from behind. As shown in FIG. 3, shell locking pieces 27 are formed on a rear part of the shield shell attaching portion 26 for locking the rear edge of the caulking tube 21 from behind. When the caulking tube 31 is attached to the shield shell attaching portion 26 from behind, the step locking surface 32 is engaged with the step 26A of the shield shell attaching portion 26 to be stopped at a front end position, while the shell locking pieces 27 lock the rear edge of the caulking tube 31 to prevent rearward detachment of the caulking tube 31. Thus, the caulking tube 31 of the shield shell 30 is held attached to the outer peripheral surface of the shield shell attaching portion 26.

An end of a braided wire (not shown) is mounted on the outer periphery of the caulking tube 31 for collectively covering the wires W. A caulk ring 34 is mounted and caulked on the outer periphery of the braided wire to crimp the braided wire to the outer periphery of the caulking tube 31.

Nut supports 28 are formed before the terminal accommodating portions 21 in the housing 20 and support the nuts 44 assembled with the connecting portions 42. The nut supports 28 project forward from the front end openings 22 of the terminal accommodating portions 21. Further, as shown in FIG. 2, each nut support 28 is a recess with an open upper surface, and an escaping hole 28A is formed in the bottom surface of the nut support 28 to allow a shaft of an unillustrated bolt to escape. As shown in FIG. 3, this escaping hole 28A is located before a locking lance 29 formed on a base end part of the nut supporting portion 28. Further, the front end of the locking lance 29 is located before the front end opening 22 of the terminal accommodating portion 21.

Figure 8:
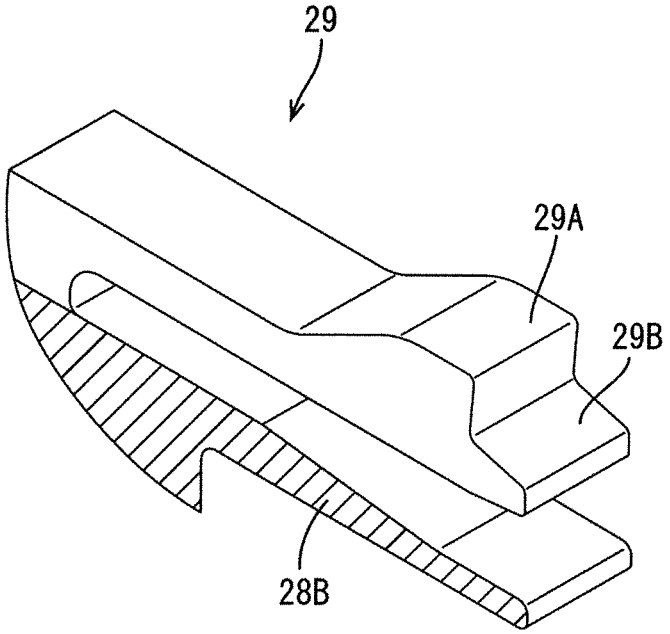
FIG. 8 is a perspective view of a locking lance viewed obliquely from front.

The locking lance 29 is cantilevered forward from the lower surface of the front end of the terminal accommodating portion 21. As shown in FIG. 8, a locking projection 29A is formed on the upper surface of the locking lance 29 for locking a side edge 44A of the nut 44 from behind. Further, an unlocking projection 29B projects forward on the lower end of the front surface of the locking projection 29A. The unlocking projection 29B can be caught with a jig to deflect the locking lance 29 down so that a locked state between the locking projection 29A and the outer edge of the nut 44 can be released.

Figure 7:
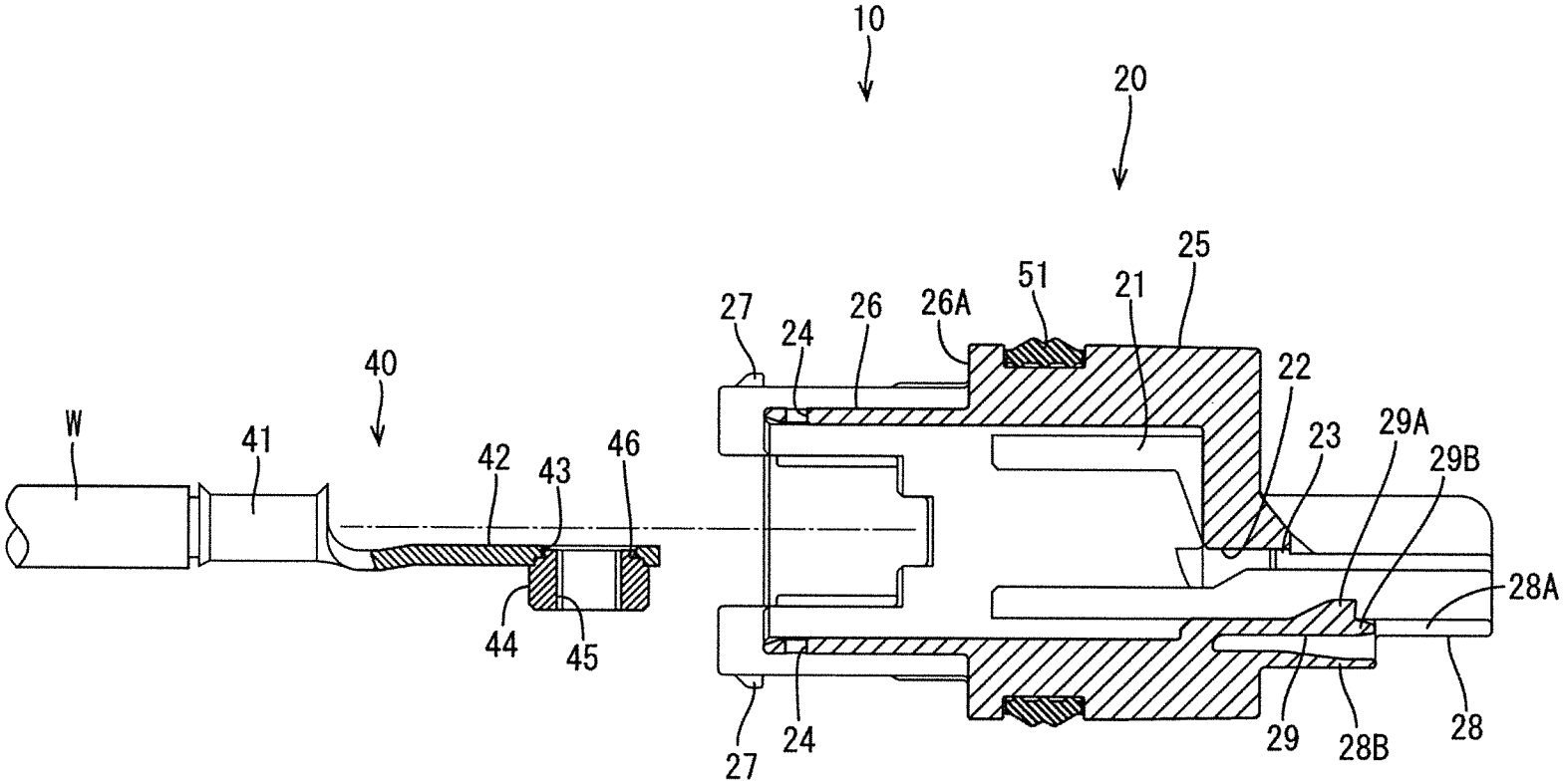
FIG. 7 is a side view in section showing a state before the terminal is inserted into the terminal accommodating portion.

As shown in FIG. 7, the locking lance 29 is at substantially the same height as the nut support 28. Further, as shown in FIG. 5, the locking projection 29A is located before the front stop 23 and outside the housing 20. As shown in FIG. 2, a protection wall 28B is formed around the locking lance 29 for protecting the locking lance 29. The protection wall 28B is formed by causing the bottom surface of the nut support 28 to bulge down.

As shown in FIG. 3, the front ends of the connecting portion 42 and the nut support 28 are aligned in a state where the locking projection 29A locks the outer part of the nut 44 from behind. As shown in FIG. 2, the connecting portion 42 is close the open upper surface of the nut support 28. Further, the bolt hole 45 of the nut 44 overlaps the escaping hole 28A of the nut support 28.

The shield shell 30 is attached to the housing 20 and the insulation coatings W2 are removed at the ends of the wires W to expose the cores W1. These exposed cores W1 are placed on the barrels 41 and the barrels 41 are crimped to the cores W1. The terminals 40 then are inserted into the terminal accommodating portions 21 from behind sufficiently for the front ends of the connecting portions 42 to project to the outside of the housing 20 through the front end openings 22 of the terminal accommodating portions 21. At this time, the outer parts of the nuts 44 move forward while deflecting the locking lances 29 downward. When the front ends of the connecting portions 42 move over the locking projections 29A, the locking lances 29 resiliently restore to lock the outer parts of the nuts 44 from behind. In this way, the terminals 40 are held in a state where backward detachments are prevented.

The braided wire then is mounted on the outer peripheral surface of the caulking tube 31 of the shield shell 30 and the caulk ring 34 is caulked on the outer peripheral surface of this braided wire to sandwich the braided wire between the caulking tube 31 and the caulk ring 34. Thus, the caulking tube 31 is fixed and electrically conductively connected to the shield shell 30. The fitting 25 of the housing 20 then is fit into the mounting hole of the device. The connecting portions 42 and terminals in the casing then are bolt-fastened and the mounting portion 33 of the shield shell 30 is bolt-fastened to the casing of the device. In this way, the connector 10 is held in the mounting hole.

As described above, a locking lance 29 locks the outer part of the nut 44 from behind. Thus, a locking hole to be locked by the locking lance 29 need not be formed separately from the bolt hole and the connecting portion 42 can be shortened in the front-back direction. Accordingly, the terminal accommodating portion 21 for accommodating the terminal 40 can be shortened in the front-back direction and the connector 10 can be made smaller in the front-back direction.

The locking lance 29 is cantilevered forward and the front end of the locking lance 29 is located before the front end opening 22 of the terminal accommodating portion 21. Accordingly, the locking lance 29 easily locks the outer part of the nut 44 even if the nut 44 is mounted on the front end part of the connecting portion 42.

The projections 47 may project laterally from the side edges of the connecting portion 42 and the front stops 23 may be formed on the inner side walls of the front end opening 22 of the terminal accommodating portion 21. The front stops 23 are at a position where a wall is formed over the entire periphery. Thus, a strong force applied from the projections 47 to the front stops 23 does not cause opening deformations of the inner side walls of the front end opening 22 of the terminal accommodating portion 21 and the connecting portion 42 can be firmly stopped at the front end position.

Next, a second embodiment of the invention is described with reference to FIGS. 9 to 12. In this embodiment a connector 110 is provided with a housing 120 formed with locking lances 129 instead of the locking lances 29 of the first embodiment. Note that the same components as in the first embodiment are denoted by the same reference signs as in the first embodiment, and the same components, functions and effects as in the first embodiment are not described to avoid repeated description.

Figure 9:
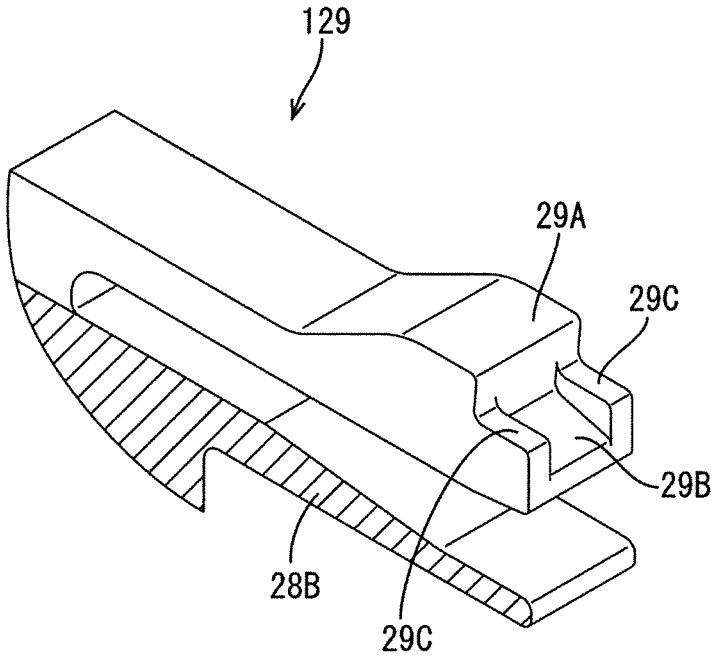
FIG. 9 is a perspective view showing a locking lance in a second embodiment viewed obliquely from front.
Figure 10:
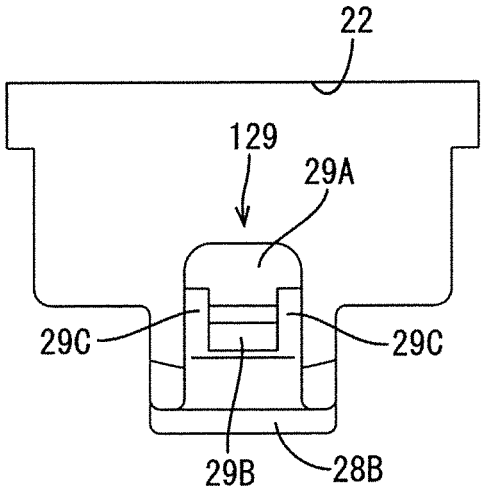
FIG. 10 is a front view of the locking lance.

The locking lance 129 of this embodiment is cantilevered forward, as shown in FIGS. 9 and 10. A locking projection 29A is formed on the upper surface of the locking lance 129 for locking an outer part of a nut 44 from behind. Further, an unlocking projection 29B project forward on the lower end of the front surface of the locking projection 29A of the locking lance 129. Two side walls 29C project up at opposite side edge parts of the unlocking projection 29B and are coupled to the front surface of the locking projection 29A. Upper ends of the side walls 29C are located below the upper end of the locking projection 29A. Further, the upper surface of the unlocking projection 29B is inclined down toward the front, whereas the upper surfaces of the side walls 29C are horizontal surfaces extending forward.

Figure 11:
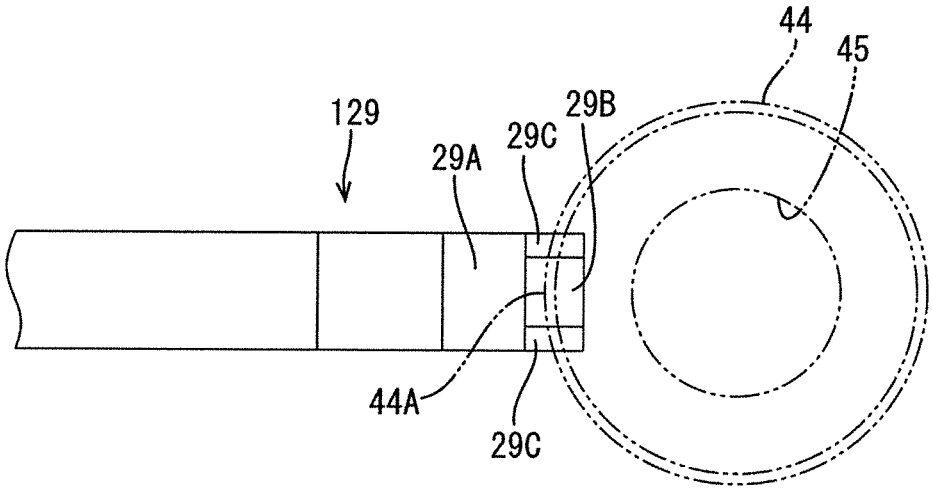
FIG. 11 is a plan view showing a state where the locking lance is locking an outer edge part of a nut.
Figure 12:
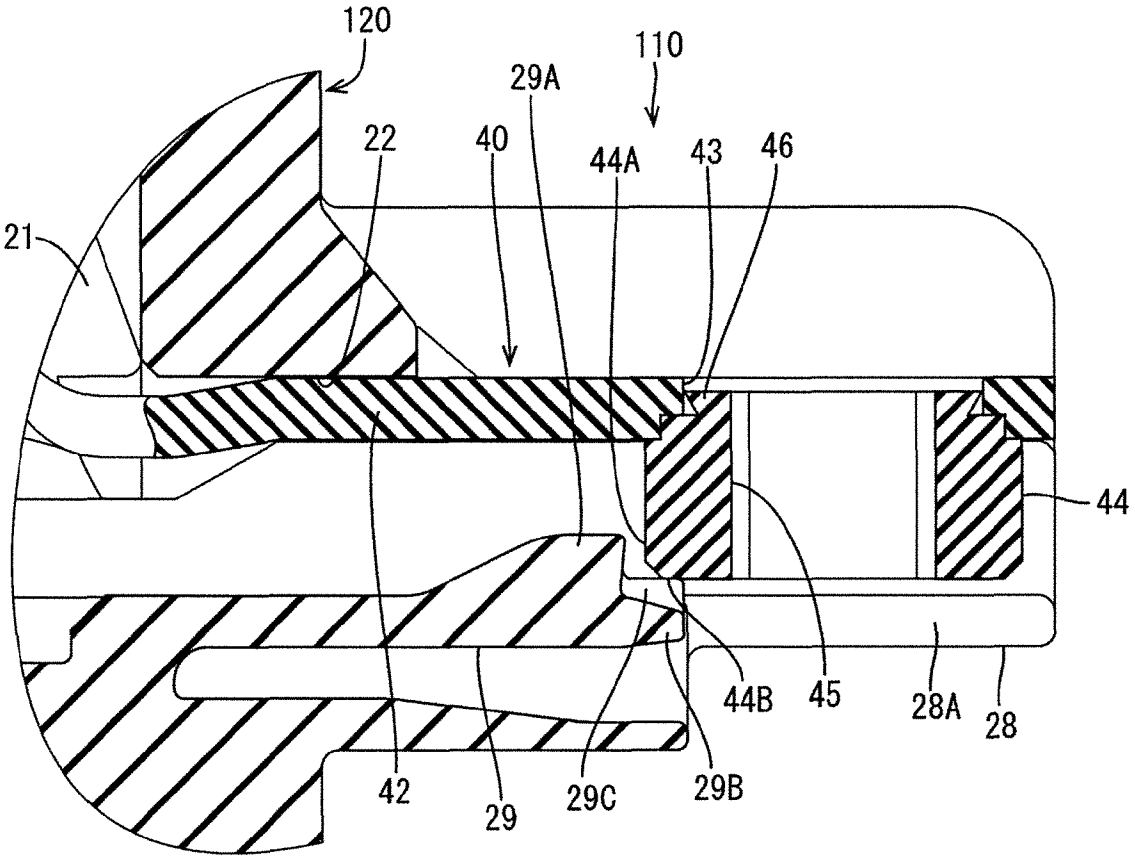
FIG. 12 is a side view in section showing the state where the locking lance is locking the outer edge part of the nut.
Figure 13:
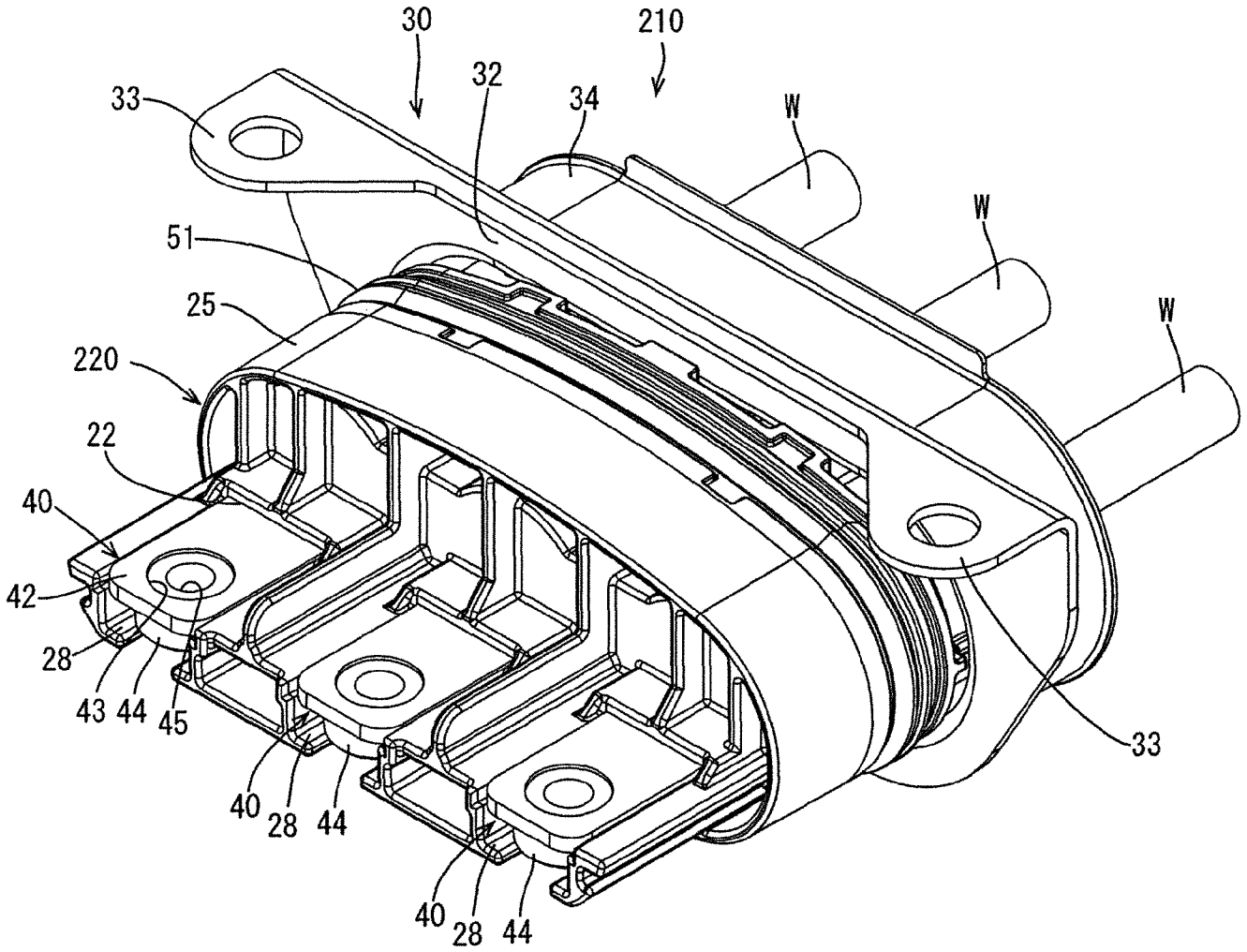
FIG. 13 is a perspective view of a connector in a third embodiment viewed obliquely from front.
Figure 14:
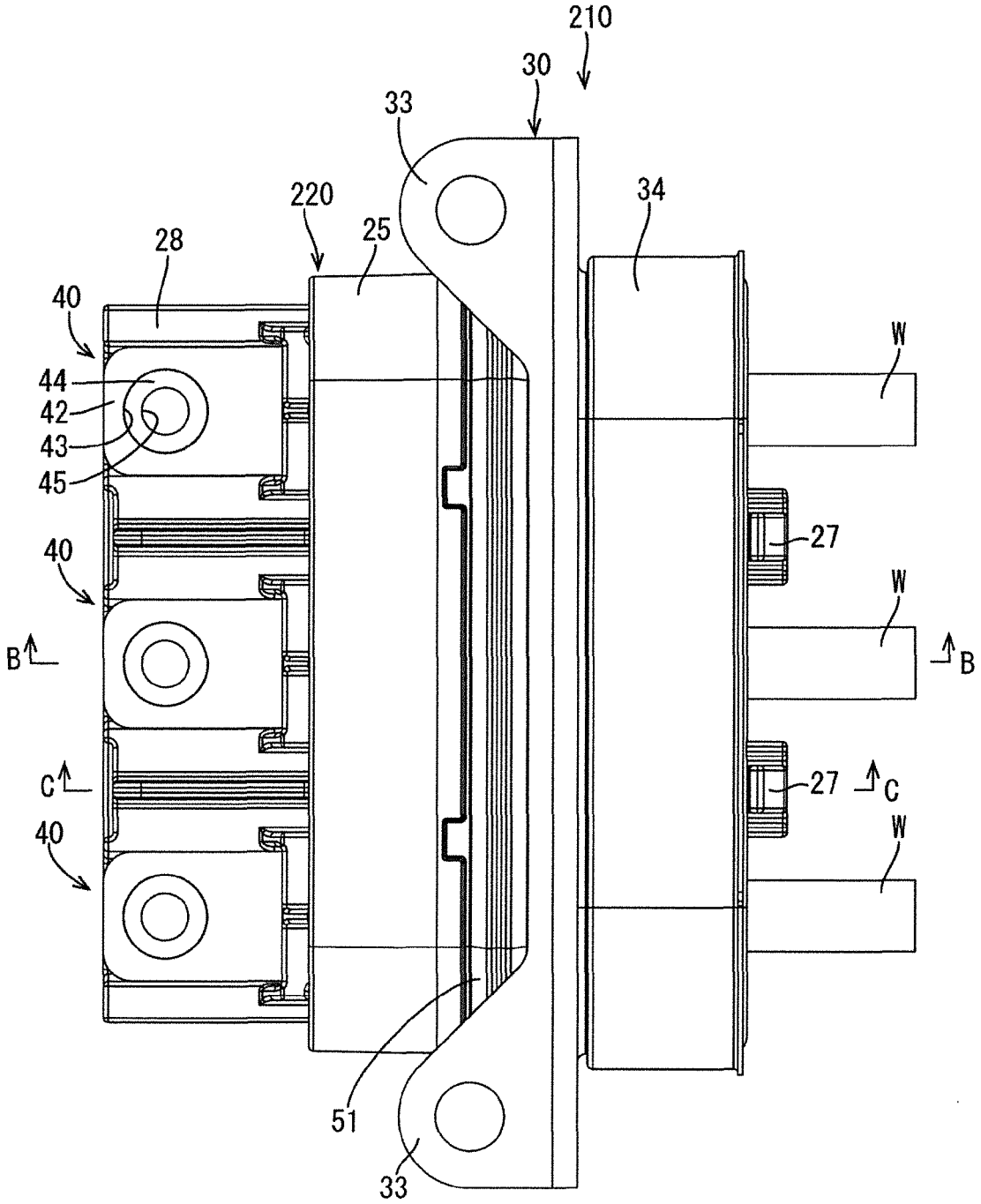
FIG. 14 is a plan view of the connector.
Figure 15:
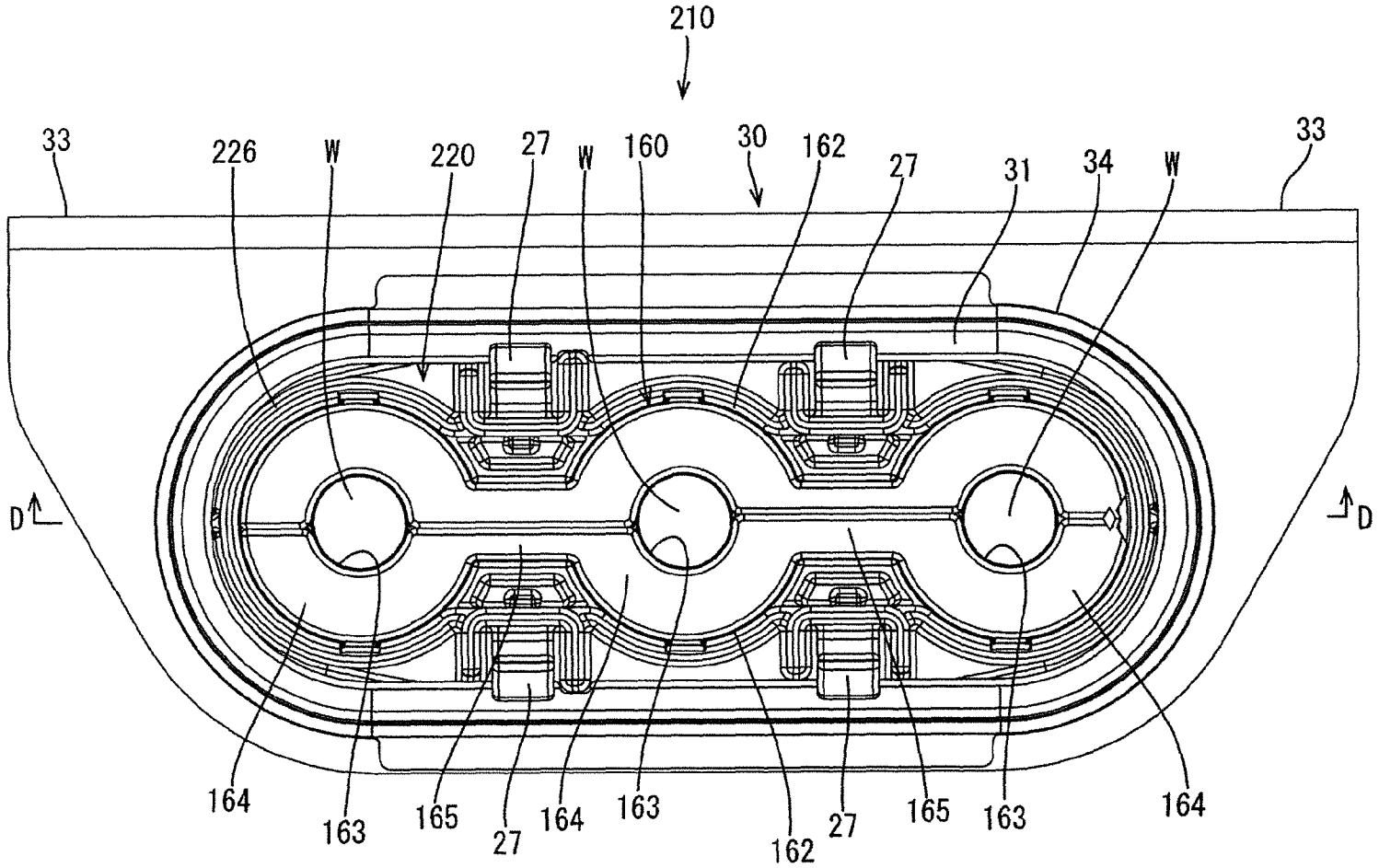
FIG. 15 is a rear view of the connector.

When a terminal 40 is inserted into a terminal accommodating portion 21 from behind, the locking projection 29A locks a side edge 44A of the outer part of the nut 44 from behind as shown in FIG. 11. Further, the side walls 29C lock a lower edge 44B of the outer part of the nut 44 from below. As shown in FIG. 12, the side walls 29C contact the nut 44 in a natural state. The locking lance 129 resiliently restores when the nut 44 moves over the locking projection 29A of the locking lance 129, and the side walls 29C swiftly hit the lower edge 44B of the nut 44 to generate a hitting sound, vibration and the like to indicate that the nut 44 is locked properly by the locking lance 129. Thus, it is possible to improve a terminal insertion feeling while preventing insufficient insertion of the terminal 40.

A third embodiment of the invention is described with reference to FIGS. 13 to 26. A connector 210 of this embodiment is obtained by partly changing the shape of the back retainer 60 of the first embodiment. The same components as in the first embodiment are denoted by the same reference signs as in the first embodiment, and the same components, functions and effects as in the first embodiment are not described to avoid repeat.

Figure 16:
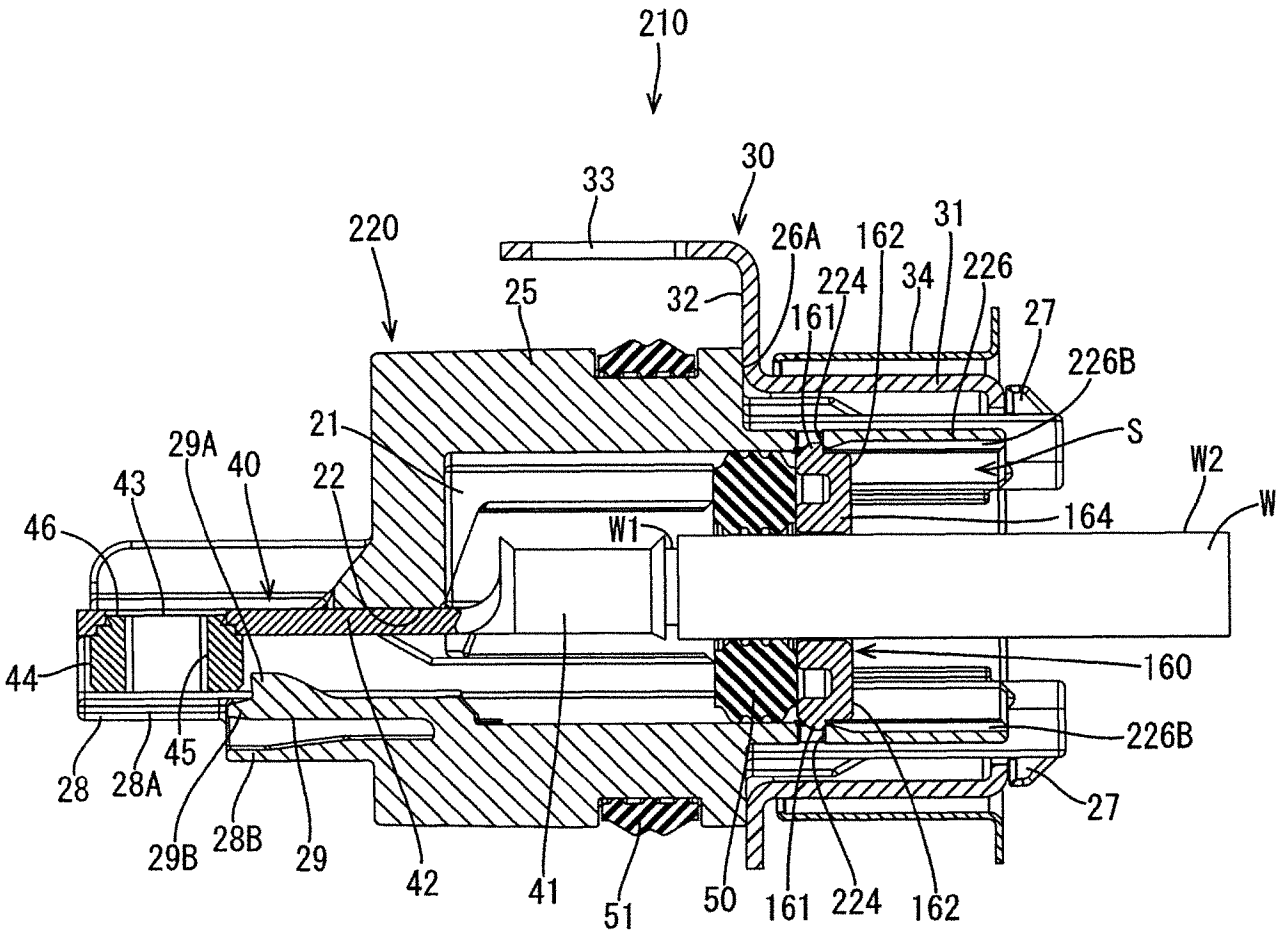
FIG. 16 is a section along B-B of FIG. 14.
Figure 20:
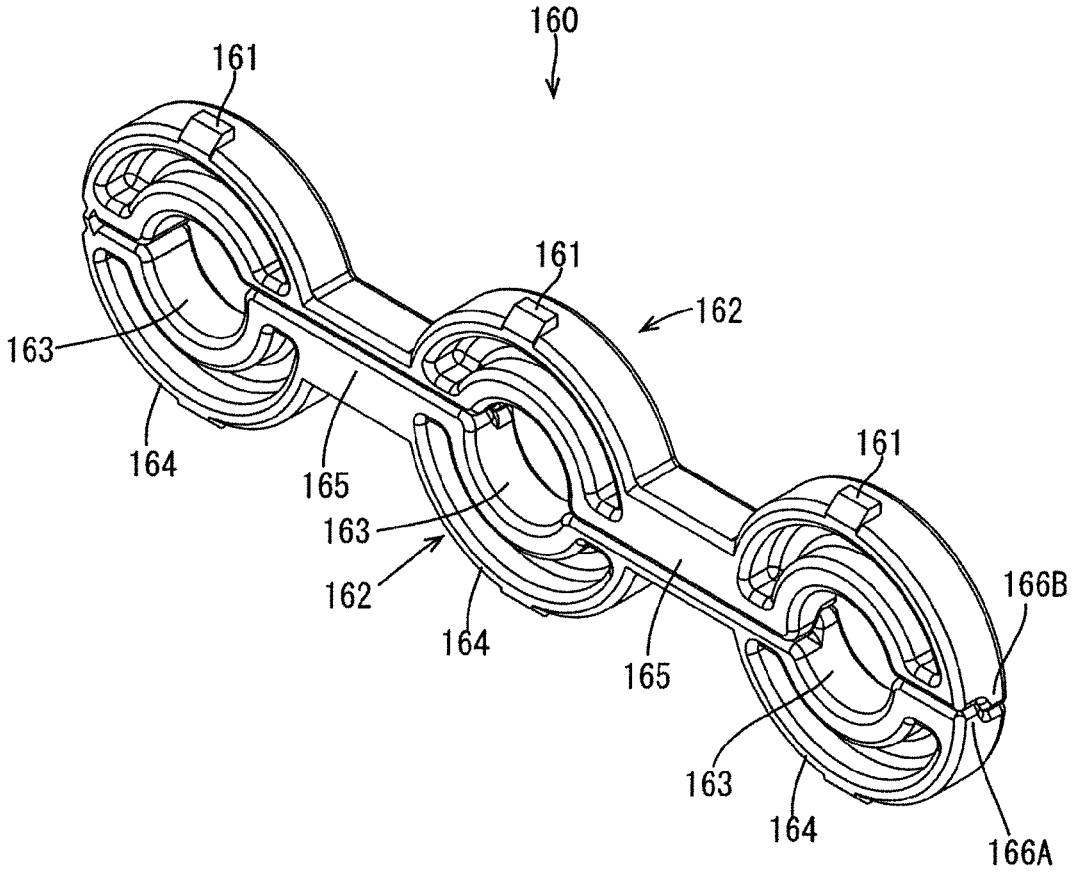
FIG. 20 is a perspective view of a back retainer viewed obliquely from front in a state where a pair of half bodies are closed.
Figure 21:
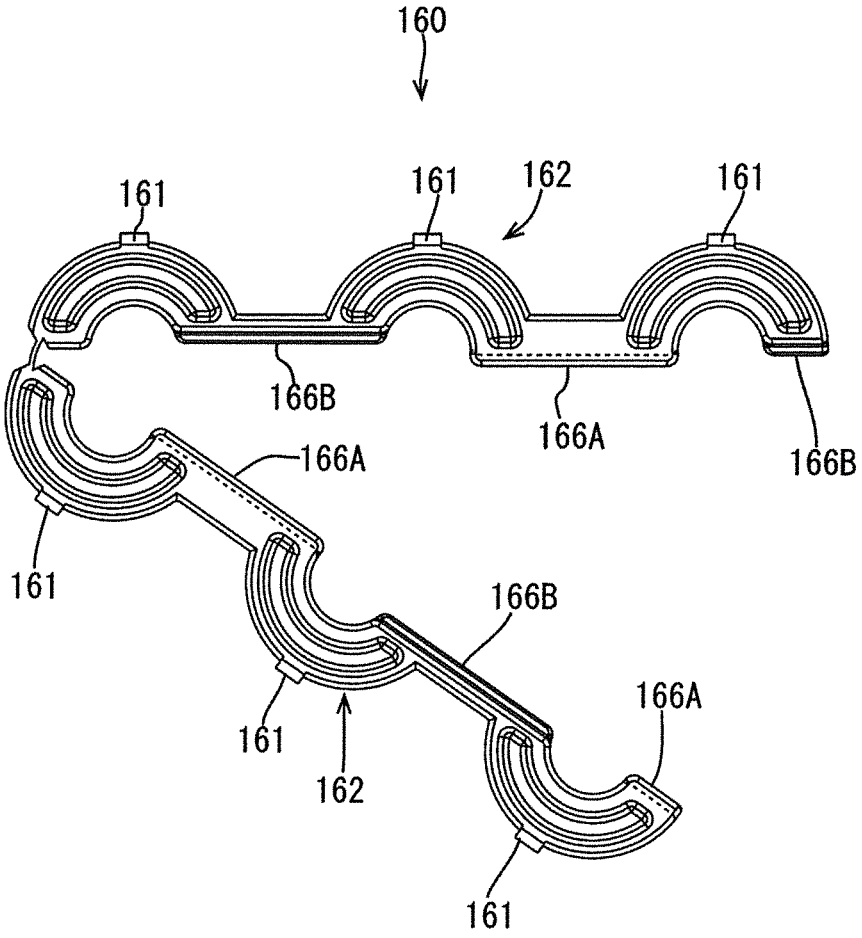
FIG. 21 is a front view of the back retainer in a state where the pair of half bodies are opened.
Figure 22:
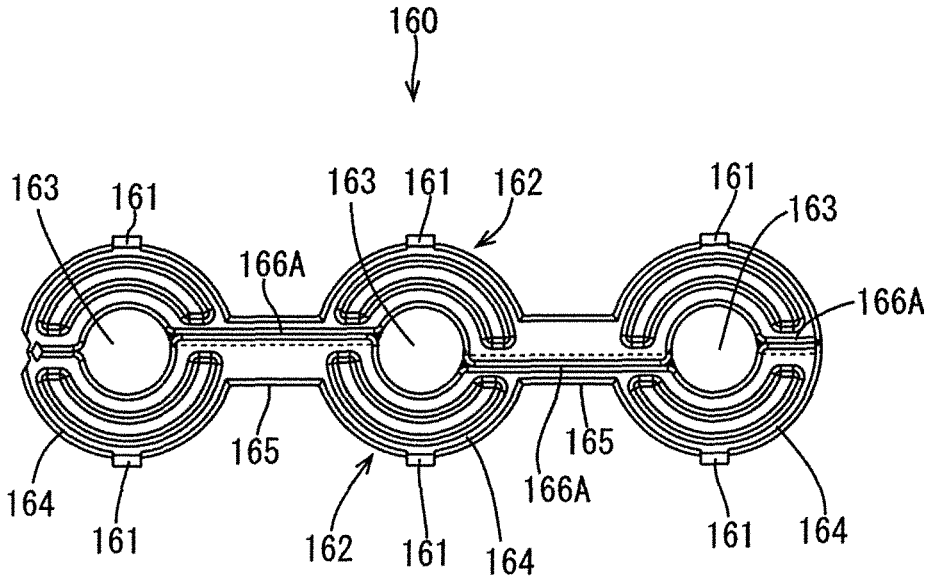
FIG. 22 is a front view of the back retainer in the state where the pair of half bodies are closed.
Figure 23:
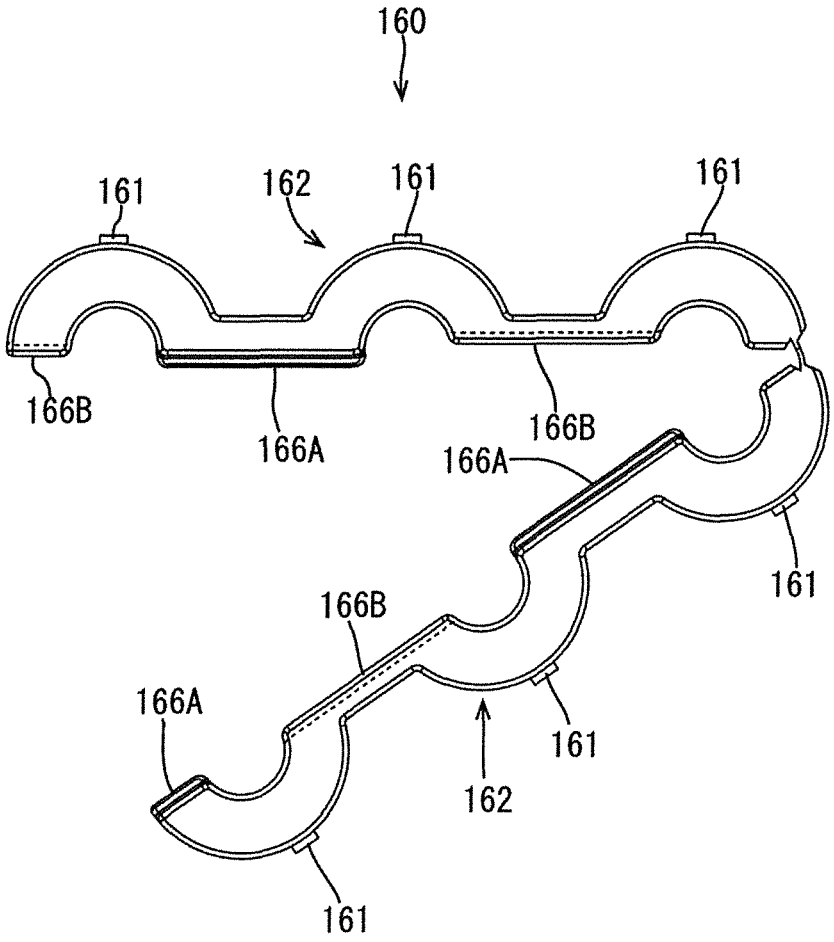
FIG. 23 is a rear view of the back retainer in the state where the pair of half bodies are opened.

A back retainer 160 of this embodiment is formed by assembling two half bodies 162 coupled by a hinge, as shown in FIGS. 20 to 22. The back retainer 160 is formed with a plurality of wire insertion holes 163 for allowing the insertion of wires W. An annular retaining portion 164 is formed around each wire insertion hole 163, and two adjacent retaining portions 164 are coupled to each other by a coupling 165. As shown in FIG. 16, the retaining portion 164 prevents a backward detachment of a rubber plug 50.

Figure 26:
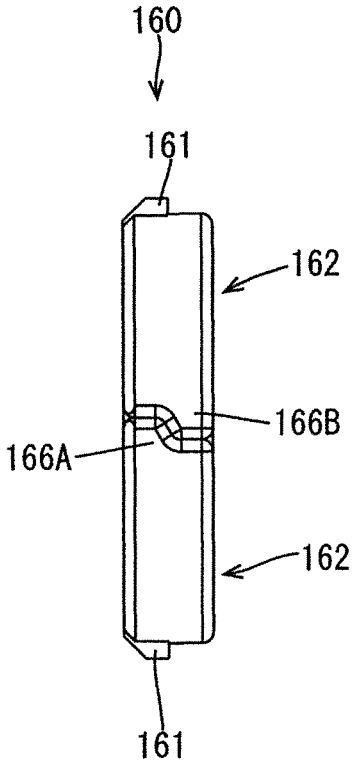
FIG. 26 is a side view of the back retainer in the state where the pair of half bodies are closed.

As shown in FIG. 26, front and rear positioning projections 166A, 166B are formed respectively on joint surfaces of the two half bodies 162 and are engageable with each other. The rear positioning projection 166B of the upper half body 162 is formed on the joint surface located on a right side of the lower end of the right retaining portion 164 shown in FIG. 21 and is arranged on a back side with respect to the plane of FIG. 26. The front positioning projection 166A is formed on the joint surface located on a left side of the lower end of the same retaining portion 164 and is on a front side with respect to the plane of FIG. 26. This front positioning projection 166A is formed from the left side of the lower end of the right retaining portion 164 to a right side of the lower end of the middle retaining portion 164. Similarly, the rear positioning projection 166B is formed from a left side of the lower end of the shown middle retaining portion 164 to a right side of the lower end of the shown left retaining portion 164, and the front positioning projection 166A is formed on a left side of the lower end of the shown left retaining portion 164.

Figure 24:
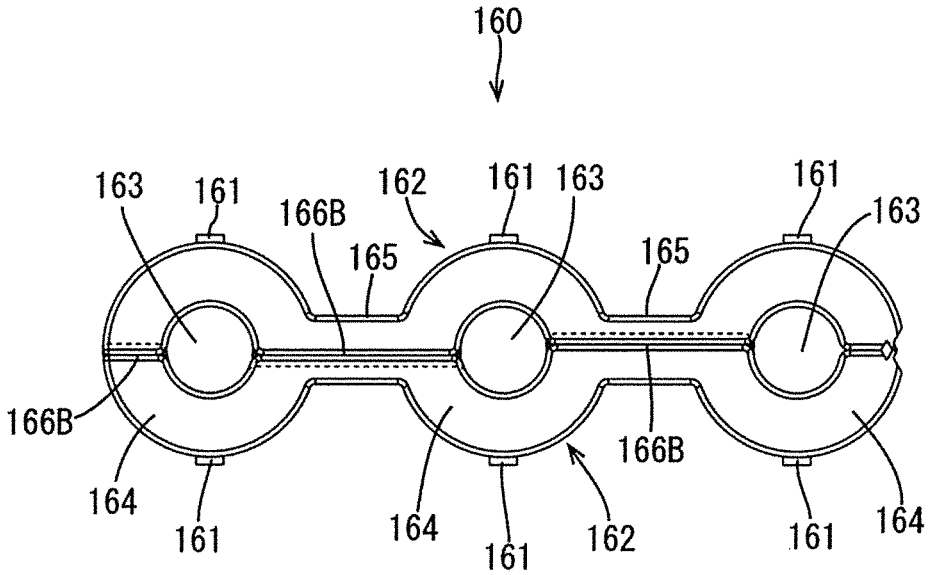
FIG. 24 is a rear view of the back retainer in the state where the pair of half bodies are closed.
Figure 25:
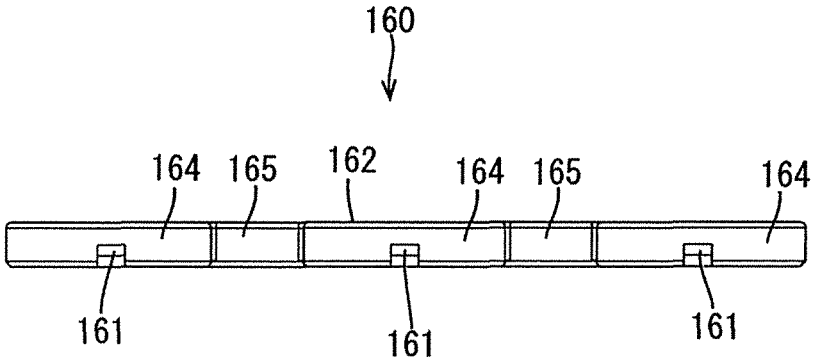
FIG. 25 is a plane view of the back retainer in the state where the pair of half bodies are closed.

The front positioning projections 166A of the upper half body 162 and the rear positioning projections 166*b* of the lower half body 162 engage when the half bodies 162 are assembled, as shown in FIGS. 22 and 24. The rear positioning projections 166B of the upper half body 162 and the front positioning projections 166A of the lower half body 162 engage to prevent displacements of the half bodies 162 in the front-back direction.

As shown in FIG. 22, lock protrusions 161 are formed on opposite upper and lower end parts of each retaining portion 164. As shown in FIG. 16, these lock protrusions 161 hold the back retainer 160 in a shield shell attaching portion 226 of a housing 220 of this embodiment by engaging lock holes 224 formed in the shield shell attaching portion 226.

The back retainer 160 is shorter in the front-back direction than the back retainer 60 of the first embodiment. Thus, the lock protrusions 161 are located more forward than the lock protrusions 61 of the first embodiment. Associated with this, the lock holes 224 are located more forward than the lock holes 24 of the first embodiment. On the other hand, introducing grooves 226B for introducing the lock protrusions 161 are formed and open backward behind the lock holes 224 in the shield shell attaching portion 226. Further, a dimension of an inner space of the shield shell attaching portion 226 in the front-back direction is longer than a dimension of the back retainer 160 in the front-back direction. Thus, a space S where the wires W are free to move is ensured behind the back retainer 160. Thus, backward projecting distances of the wires W from the space S can be suppressed when the wires W need to be suddenly bent behind the space S.

Figure 18:
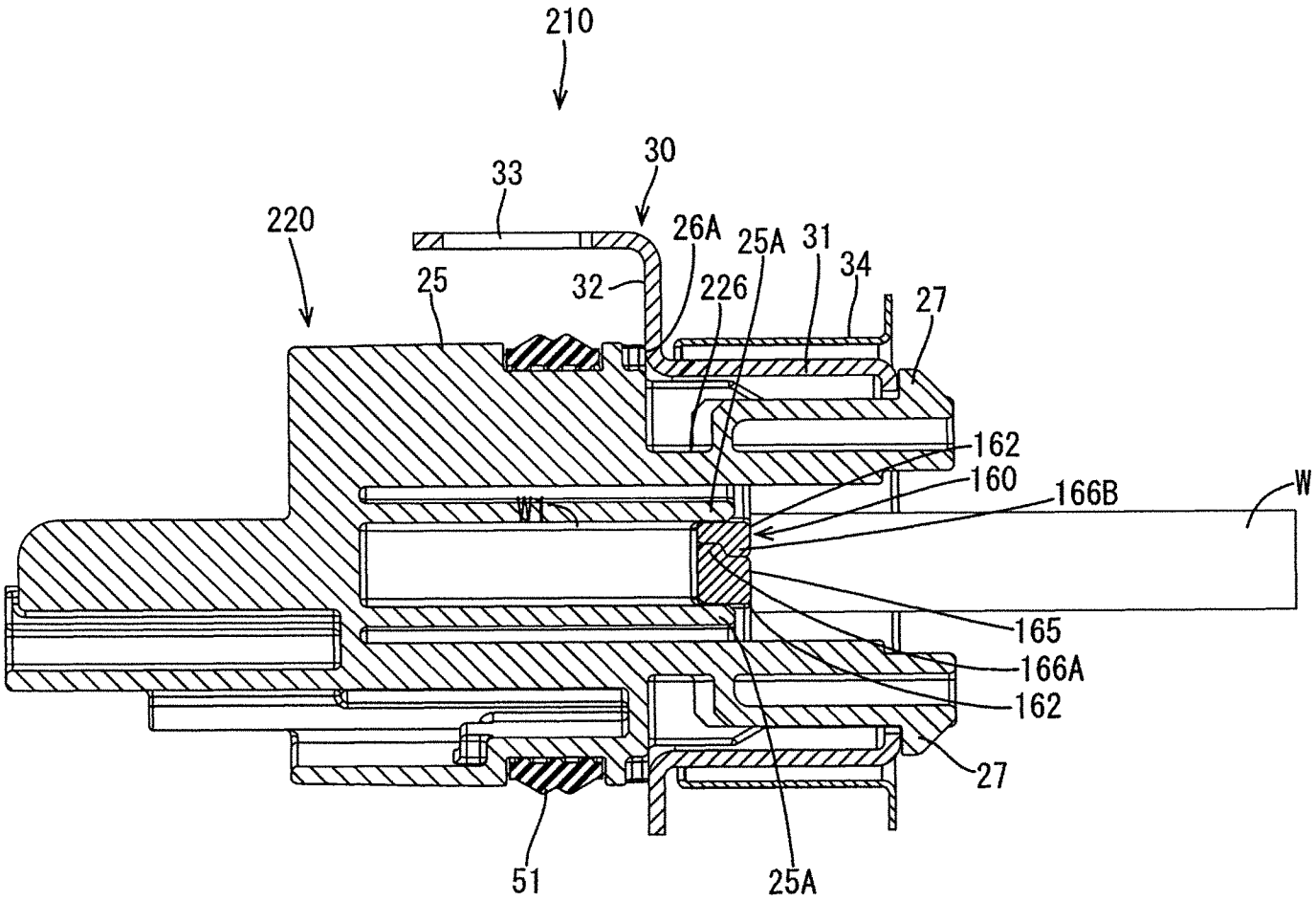
FIG. 18 is a section along C-C of FIG. 14.
Figure 19:
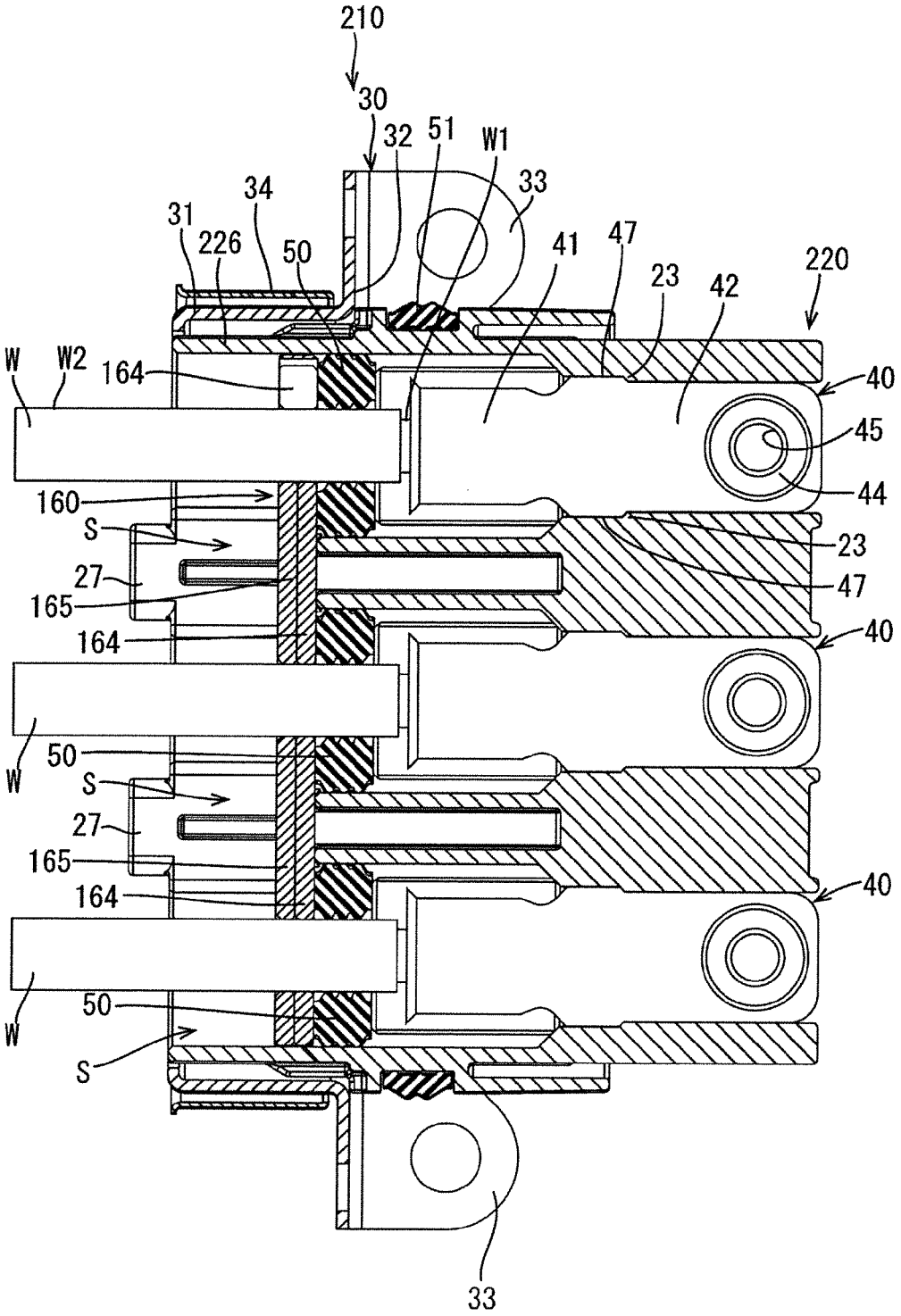
FIG. 19 is a section along D-D of FIG. 15.

If the wire W is suddenly bent, a reaction force of the wire W is created. Thus, a large force is applied to the back retainer 160. However, even in such a case, the front positioning projections 166A and the rear positioning projections 166B are engaged with each other on the joint surfaces of the half bodies 162 and the half bodies 162 are vertically sandwiched by upper and lower pressing walls 25A as shown in FIG. 18. This prevents displacements of the pair of half bodies 162 in the front-back direction.

Figure 17:
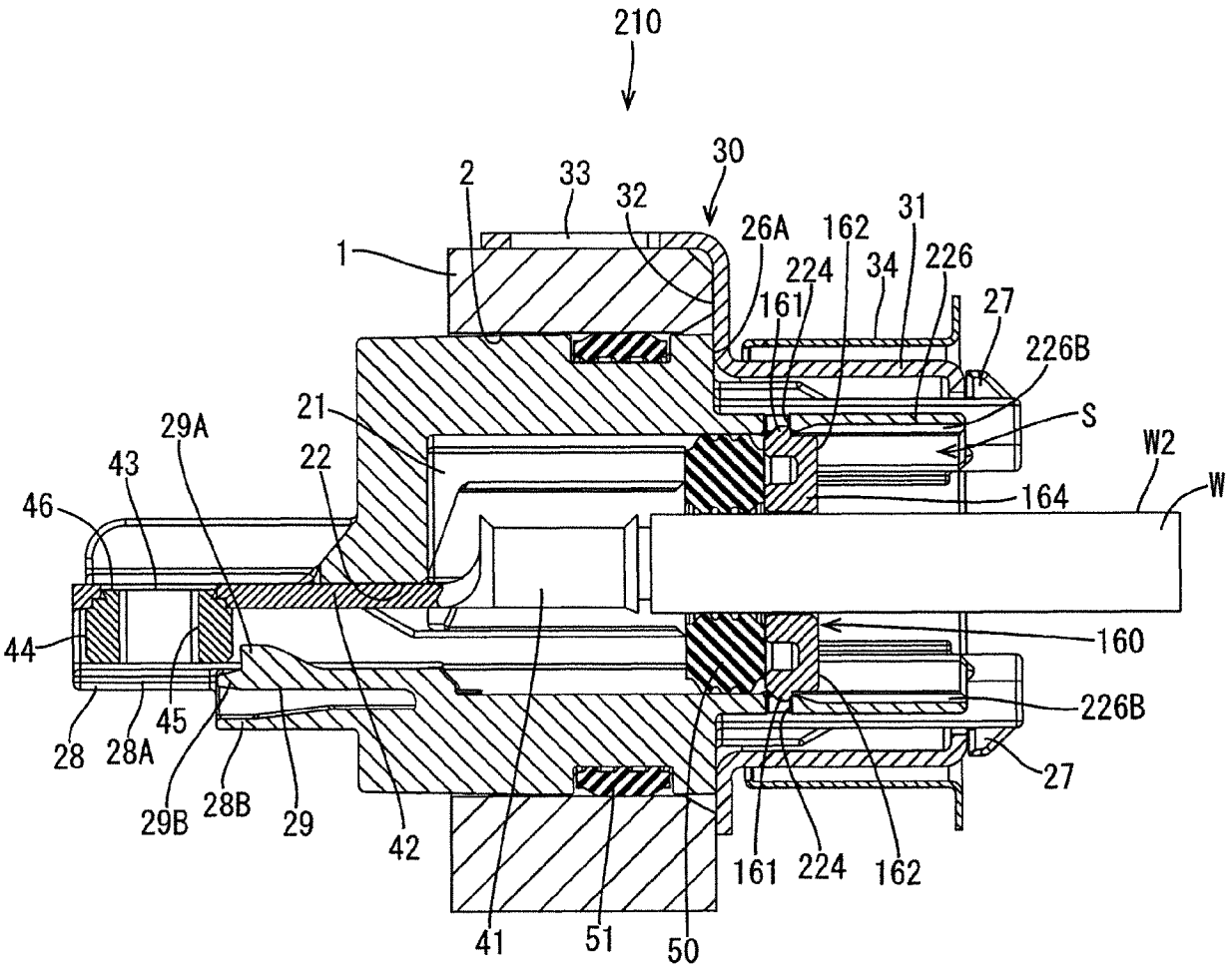
FIG. 17 is a section showing a state where the connector is fitted in a mounting hole of a device at a cross-sectional position of FIG. 16.

A structure for mounting the connector 210 to a device is described with reference to FIG. 17. A mounting hole 2 penetrates through a casing 1 of the device. When the fitting 25 of the housing 220 is fit into the mounting hole 2, the shield shell attaching portion 226 projects to the outside of the casing 1 from the mounting hole 2. However, the shield shell attaching portion 226 is surrounded by a mounting portion 33 of a shield shell 30 and is not broken in a collision. Thus, there is no possibility that adjacent terminals 40 are shorted to each other or the terminals 40 come into contact with the shield shell 30. Note that the fitting 25 and the terminals 40 accommodated in the mounting hole 2 are surrounded by the casing 1 and also are not broken in a collision test.

The invention is not limited to the above described embodiments. For example, the following embodiments are also included in the scope of the invention.

The locking portion is a deflectable locking lance in the above embodiments. However, other locking structures may be provided.

The front end of the locking lance is located before the front end opening 22 of the terminal accommodating portion 21 in the above embodiments, but it may be at the same position as the front end opening 22 of the terminal accommodating portion 21.

The projections 47 project laterally from the side edges of the connecting portion 42 in the above embodiments. However, a projecting portion may be provided by cutting and bending a part of the connecting portion according to the invention.

What is claimed is:

1. A connector, comprising:

a terminal including a connecting portion formed with a nut mounting hole, the terminal further having at least one projection;

a nut integrally mounted on the connecting portion and including a bolt hole that coaxially communicates with the nut mounting hole; and a housing formed with a terminal accommodating portion that accommodates the terminal, a locking portion formed in the housing and configured to retain the connecting portion by engaging an outer part of the nut from behind, and a front stop formed in the terminal accommodating portion and engaging the projection of the terminal to stop the connecting portion at a front end position when the locking portion engages the nut from behind.

2. The connector of claim 1, wherein the locking portion is a locking lance cantilevered forward, a front end of the locking lance being located before a front end opening of the terminal accommodating portion.

3. The connector of claim 2, wherein the projection projects laterally project from a side edge of the connecting portion, and the front stop portion is formed on an inner side wall of a front end opening of the terminal accommodating portion.

4. The connector of claim 1, wherein the housing includes a fitting fittable into a mounting hole that penetrates through a metal casing made and a shield shell attaching portion to which a metal shield shell (30) is to be attached, and a part of the housing projecting to the outside of the casing from the mounting hole is surrounded by the shield shell.

5. A housing for accommodating a terminal including a nut (44) and a projection, comprising:

a locking portion configured to retain the terminal by locking an outer part of the nut from behind; and a front stop configured to stop the terminal at a front end position by locking the projection from front.

* * * * *